US006923671B2

(12) United States Patent
Uezono

(10) Patent No.: US 6,923,671 B2
(45) Date of Patent: Aug. 2, 2005

(54) ELECTRIC CONNECTION BOX

(75) Inventor: Koichi Uezono, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/635,507

(22) Filed: Aug. 7, 2003

(65) Prior Publication Data

US 2004/0058569 A1 Mar. 25, 2004

(30) Foreign Application Priority Data

Aug. 8, 2002 (JP) ..... 2002-230975

(51) Int. Cl.[7] ..... H01R 4/26
(52) U.S. Cl. ..... 439/404; 439/443
(58) Field of Search ..... 439/397, 404, 439/405, 443, 877

(56) References Cited

U.S. PATENT DOCUMENTS 5,934,929 A * 8/1999 Saka et al. ..... 439/404
6,447,325 B1 * 9/2002 Yamane et al. ..... 439/404
6,494,723 B2 * 12/2002 Yamane et al. ..... 439/76.2
6,533,604 B2 * 3/2003 Kobayashi et al. ..... 439/404

FOREIGN PATENT DOCUMENTS

JP 5-300627 11/1993

* cited by examiner

*Primary Examiner*—Thanh-Tam Le
(74) *Attorney, Agent, or Firm*—Oblon, Spivak, McClelland, Maier & Neustadt, P.C.

(57) ABSTRACT

An electric connection box provided with a wiring board 20 having an electric wire 21 arranged on both surfaces of an obverse surface 20*a* and a reverse surface 20*b*, an obverse cover arranged on the obverse surface 20*a* of the wiring board 20 and having a connector cavity, a reverse cover arranged on the reverse surface 20*b* of the wiring board 20 and having a connector cavity, and press contact terminals 10, 10A and 10B each having a press contact edge portion 11 pressed onto the electric wire 20 and a tab portion 12 and/or 13 erected in the connector cavity, wherein the press contact terminal 10, 10A or 10B presses the press contact edge portion 11 onto the electric wire 21 from a side where the electric wire 21 is arranged, thereby selectively erecting the terminal portion 12 and/or 13 on both surfaces of a surface having the electric wire 21 arranged thereon and/or a surface opposite to the surface.

5 Claims, 8 Drawing Sheets

Related Art

Related Art

Related Art

ELECTRIC CONNECTION BOX

CROSS REFERENCE TO RELATED APPLICATIONS

This application is based upon and claims the benefit of priority from the prior Japanese Patent Applications No. P2002-230975, filed on Aug. 8, 2002; the entire contents of which are incorporated herein by reference.

BACKGROUND OF THE INVENTION

1. Field of the Invention

The present invention relates to an electric connection box in which a terminal portion of a press contact terminal pressed onto an electric wire arranged on a wiring board is erected in the connector cavity of a cover thereby to form a connector.

2. Description of the Related Art

One example of an electric connection box in the related art is disclosed in Japanese Patent Application Laid-Open No. H5-300627 (hereinafter referred to as a first related art) shown in FIG. 1A. Here, FIG. 1B is a partial enlarged view enlarging a part near P in FIG. 1A. This electric connection box 51A, as shown in FIG. 1A, has a wiring board 52 having an electric wire W arranged thereon, an obverse cover 53 and a reverse cover 54 that cover both surfaces of the wiring board 52 and terminal fitting grooves 55 on the surface of the wiring board 52. As shown in FIG. 1B, a press contact terminal 56 is constructed of a press contact edge portion 56*a* having an electric wire slit groove 56*c* and a tab portion 56*b* extended straight in a direction opposite to a side where the slit groove 56*c* is formed and integrally formed with the press contact edge portion 56*a*.

When the press contact terminal 56 is inserted into the terminal fitting groove 55 of the wiring board 52 from the press contact edge portion 56*a* side of the press contact terminal 56, the conductive electric wire (not shown) of the electric wire W inserted into the electric slit groove 56*c* is pressed onto the press contact edge portion 56*a* and at the same time the press contact terminal 56 is fixed in the terminal fitting groove 55. The tab portion 56*b* of this fixed press contact terminal 56 is erected in the connector cavity 53*a* of the obverse cover 53.

Moreover, another example of an electric connection box in the related art is disclosed in Japanese Patent Application Laid-Open No. H8-88922 (hereinafter referred to as a second related art) shown in FIG. 2. As shown in FIG. 2, an electric connection box 51B is made by placing a wiring board 52*a* on a wiring board 52*b* and electric wires W are received in respective electric wire receiving grooves 57 of the respective wiring boards 52*a* and 52*b*. Then, a terminal fitting hole 58 passing through the wiring boards 52*a* and 52*b* is formed at the suitable position of the wiring board 52*a* on the obverse surface side (side indicated by an arrow A) and the wiring board 52*b* on the reverse surface side (side indicated by an arrow B). The press contact terminal 59 has an electric wire slit groove 59*c* and is constructed of a press contact edge portion 59*a* and a tab portion 59*b* extended straight in a direction opposite to the side where the electric wire slit groove 59*c* is formed and formed integrally with the press contact edge portion 59*a*.

When the press contact terminal 59 is inserted into the terminal fitting hole 58 from the press contact edge portion 59*a* side of the press contact terminal 59 (inserted in the direction indicated by an arrow C), the conductive electric wire Wa of the electric wire W fitted in the electric slit groove 59*c* is pressed onto the press contact edge portion 59*a* and at the same time the press contact terminal 59 is fixed in the terminal fitting hole 58. The tab portion 59*b* of the fixed press contact terminal 59 is erected in the connector cavity of the obverse cover (not shown).

In the electric connection box 51A of the first related art, the tab portion 56*b* is erected to the electric wire W on the wiring board 52 on the same plane side as the plane having the electric wire W arranged thereon.

On the other hand, in the electric connection box 51B of the second related art, the tab portion 59*b* can be erected to the electric wires W on the wiring board 52*a* and 52*b* on the plane opposite to the plane having the electric wire W arranged thereon.

In a case of the first related art, however, the press contact terminal 56 is pressed onto the electric wire W from the surface where the electric wire W is arranged, whereas in a case of the second related art, the press contact terminal 59 is pressed onto the electric wire W from a surface opposite to the surface where the electric wire W is arranged, that is, the press contact terminals 56 and 59 are pressed onto the electric wire W in opposite directions. Therefore, in a case where the tab portions 56*b* and 59*b* are erected with respect to the electric wire W on both of the surface having the electric wire W arranged thereon and the surface opposite thereto, respectively, it is troublesome to press the press contact terminals 56, 59 onto the electric wire W and hence to check press contact connection.

Thus, the present invention has been made in order to solve the above problems. It is the object of the present invention to provide an electric connection box in which in a case where a terminal portion is erected, with respect to an electric wire arranged on a wiring board, on a surface having the electric wire arranged thereon and a surface opposite to the surface, a press contact terminal can be easily pressed onto the electric wire and press contact connection can be easily checked.

SUMMARY OF THE INVENTION

In order to solve the above problems, according to the first aspect of the present invention, there is provided an electric connection box including: a wiring board having an electric wire arranged on both surfaces of an obverse surface and a reverse surface; an obverse cover arranged on the obverse surface of the wiring board and having a first connector cavity; a reverse cover arranged on the reverse surface of the wiring board and having a second connector cavity; and a press contact terminal having a press contact edge portion pressed onto the electric wire and a tab portion erected in the first or second connector cavity, wherein the press contact terminal presses the press contact edge portion onto the electric wire from a side where the electric wire is arranged, thereby selectively erecting the terminal portion on a surface having the electric wire arranged thereon and/or a surface opposite to the surface.

BRIEF DESCRIPTION OF THE DRAWINGS

FIG. 2 is a cross sectional view of the second related art in which a press contact terminal is fitted in.

DETAILED DESCRIPTION OF THE INVENTION

Figure 1A:
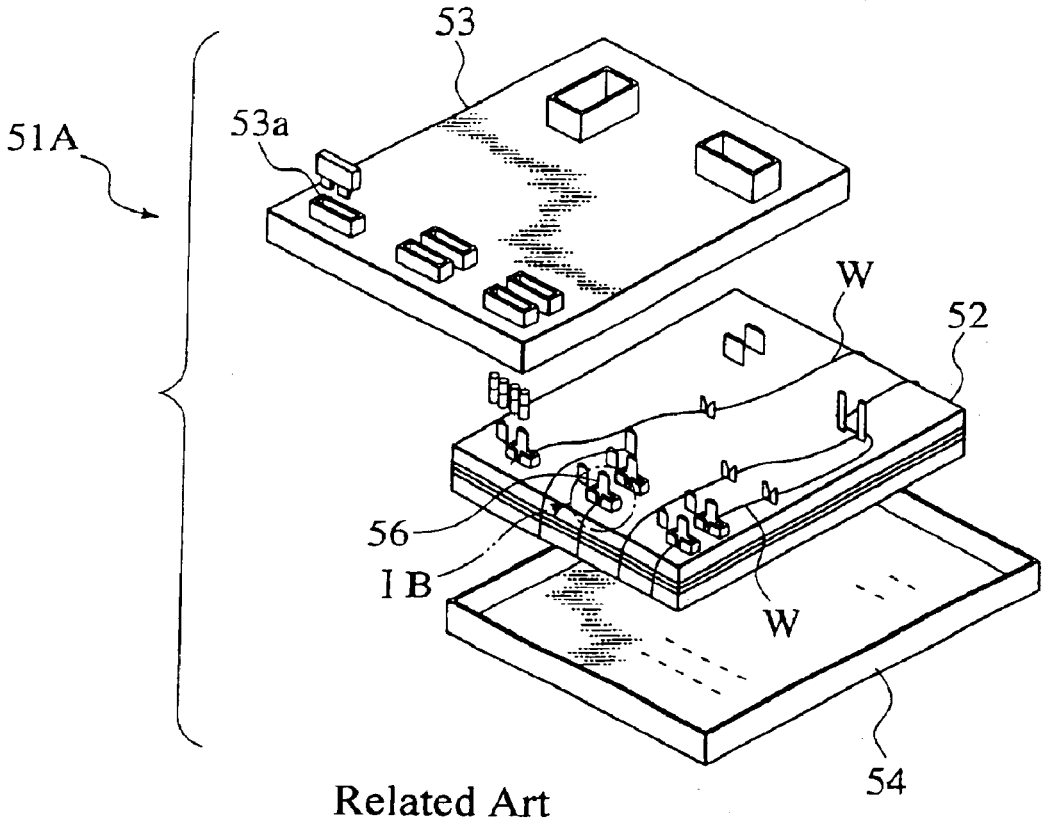
FIG. 1A is a perspective view of an electric connection box in the first related art.
Figure 1B:
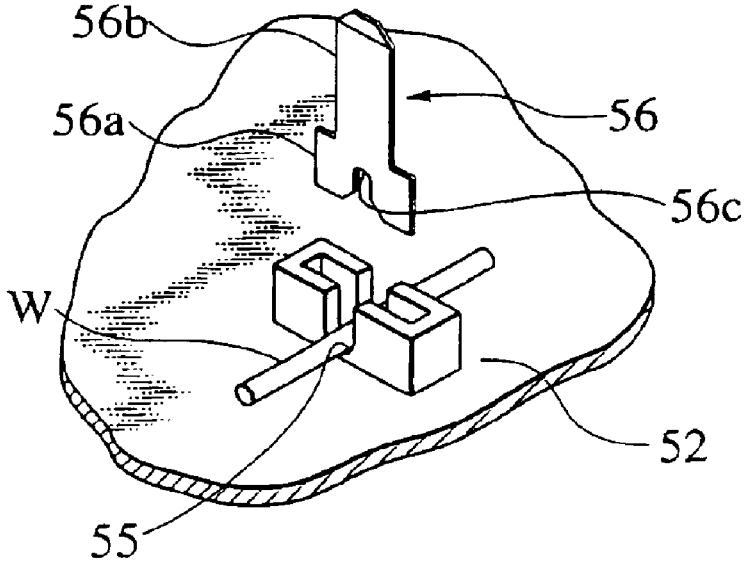
FIG. 1B is an enlarged view of a part in FIG. 1A.
Figure 2:
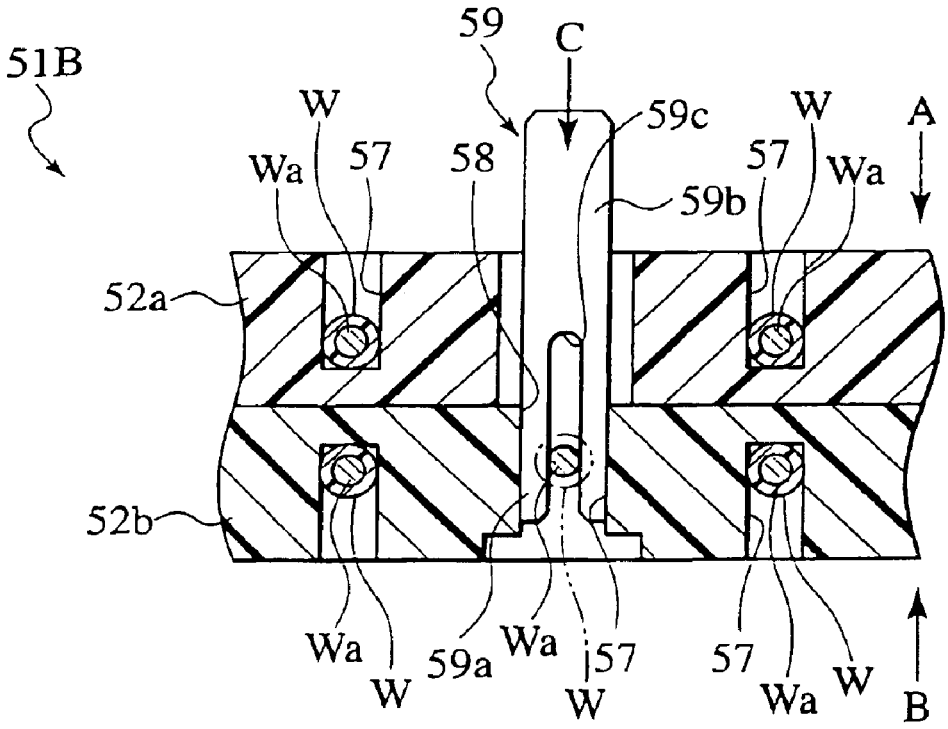

Hereinafter, one embodiment of the present invention will be described with reference to the drawings.

As shown in FIG. 3A to FIG. 3F, an electric connection box 1 comprises a wiring board 20 having electric wires 21 arranged on both surfaces of an obverse surface 20*a* and a reverse surface 20*b* thereof, an obverse cover (first cover) 3 that is arranged on the obverse surface side 20*a* of the wiring board 20 and has a first connector cavity 3*a*, a reverse cover (second cover) 4 that is arranged on the reverse surface side 20*b* of the wiring board 20 and has a second connector cavity 4*a*, and pressing contact terminals 10, 10A and 10B each having tab portions (terminal portions) 12 and (/or) 13 that are (/is) pressed onto the electric wire 21 and fixed to the wiring board 20 and provided in a protruding manner in the first and second connection cavities 3*a* and 4*a*. The respective connector cavities 3*a* and 4*a* and the tab portions (terminal portions) 12 and 13 provided therein in a protruding manner form an obverse side connector 5 and a reverse side connector 6.

Figure 7A:
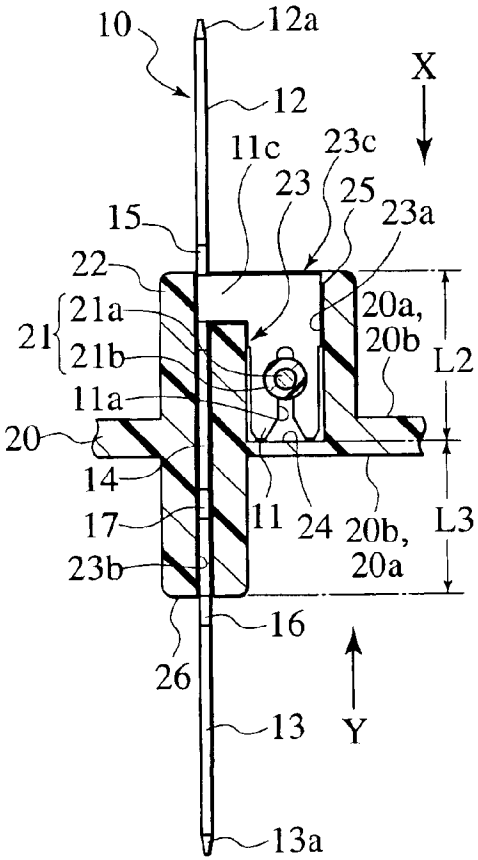
FIG. 7A shows one embodiment of the present invention, and is a cross sectional view showing a state in which a press contact terminal having both tab portions is fitted.
Figure 7B:
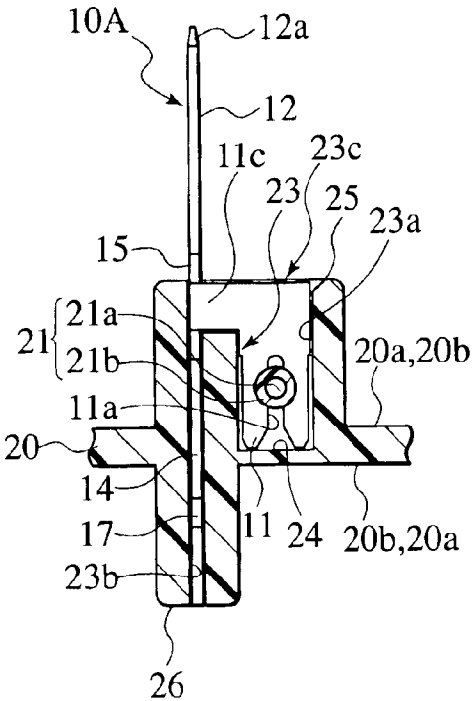
FIG. 7B shows one embodiment of the present invention, and is a cross sectional view showing a state in which a press contact terminal having only one tab portion is fitted.
Figure 7C:
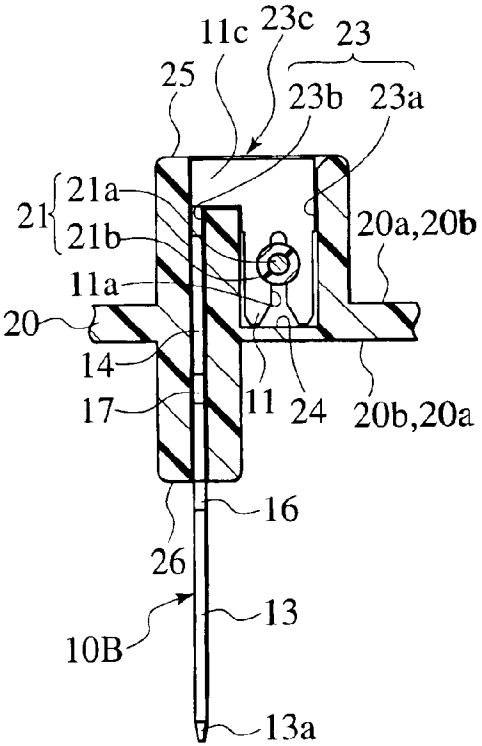
FIG. 7C shows one embodiment of the present invention, and is a cross sectional view showing a state in which a press contact terminal having only the other tab portion is fitted.

Here, as shown in FIGS. 7A, 7B, and 7C, the electric wire 21 on the wiring board 20 forms a predetermined circuit as a wiring circuit member, and is comprised of a conductive electric wire 21*a* and an insulating outer sheath 21*b* covering the outer periphery of the conductive electric wire 21*a*.

Figures 3A, 3B, 3C, 3D, 3E, 3F:
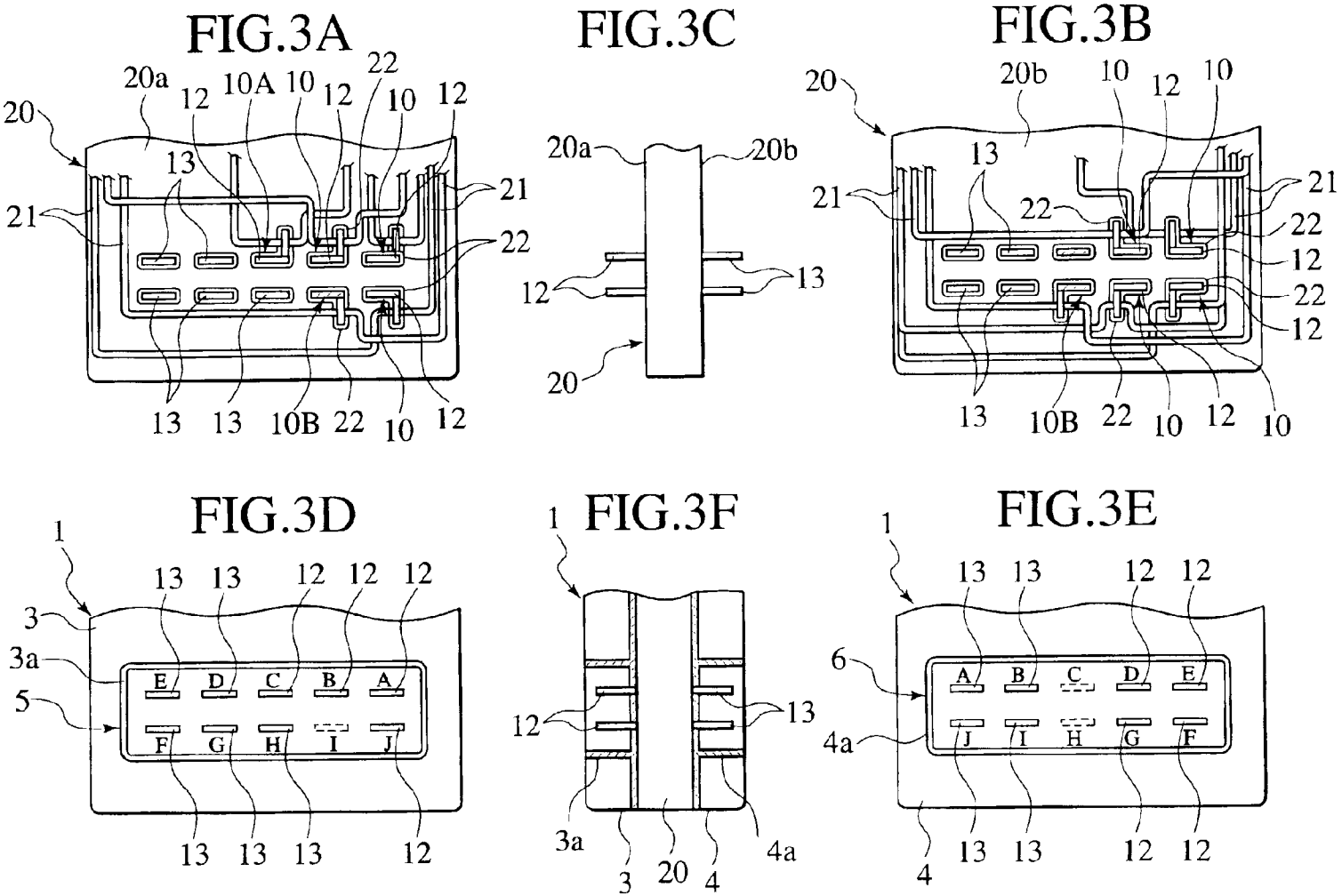
FIG. 3A is a partial plan view of a wiring board in accordance with one embodiment of the present invention.
FIG. 3B is a partial bottom view of a wiring board in accordance with one embodiment of the present invention.
FIG. 3C is a partial side view of a wiring board in accordance with one embodiment of the present invention.
FIG. 3D is a plan view of a wiring board in accordance with one embodiment of the present invention, an obverse cover being arranged on an obverse surface side.
FIG. 3E is a plan view of a wiring board in accordance with one embodiment of the present invention, a reverse cover being arranged on a reverse surface side.
FIG. 3F is a plan view of a wiring board in accordance with one embodiment of the present invention, an obverse cover and a reverse cover being arranged on an obverse surface side and a reverse surface side.

Both of the connector cavities 3*a* and 4*a* of the obverse cover 3 and the reverse cover 4 are arranged at the same position of the obverse and reverse covers 3 and 4, and the terminal insertion positions in both of the connector cavities 3*a* and 4*a* are also arranged at the same position of the obverse and reverse covers 3 and 4. As shown in FIGS. 3D and 3E, when ten terminal insertion positions in the respective connector cavities 3*a* and 4*a* are denoted by reference symbols A to J, the terminal insertion positions with the same reference symbols are set at the same terminal insertion positions of the obverse and reverse surfaces. The tab portions (terminal portions) 12 and 13 are erected in the respective terminal insertion positions except for the terminal insertion position I on the obverse surface 20*a* side and the terminal insertion position H on the reverse surface 20*b* side (portions hatched in FIGS. 3A and 3B) by the use of three types of press contact terminals 10, 10A and 10B, which will be described later. Then, terminal mounting members 22 in which the press contact terminals 10, 10A and 10B are mounted are provided at the positions corresponding to the respective terminal insertion positions of the wiring board 20.

Figure 4A:
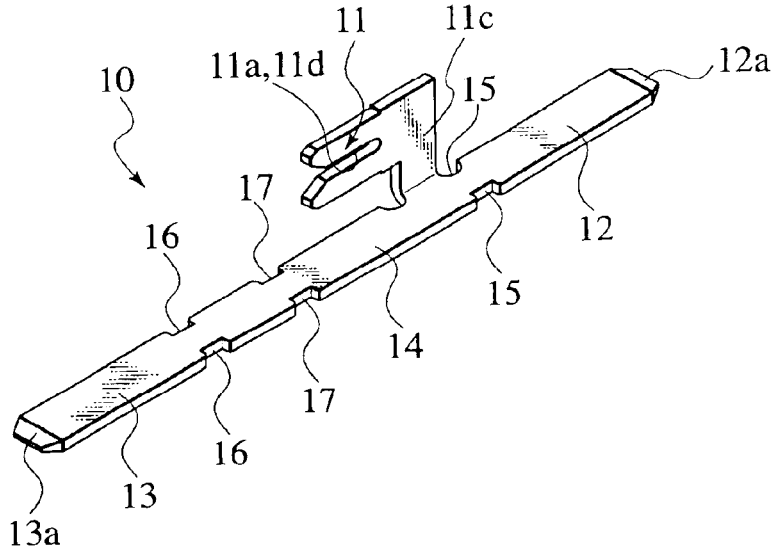
FIG. 4A is a perspective view of a press contact terminal in accordance with one embodiment of the present invention.
Figure 4B:
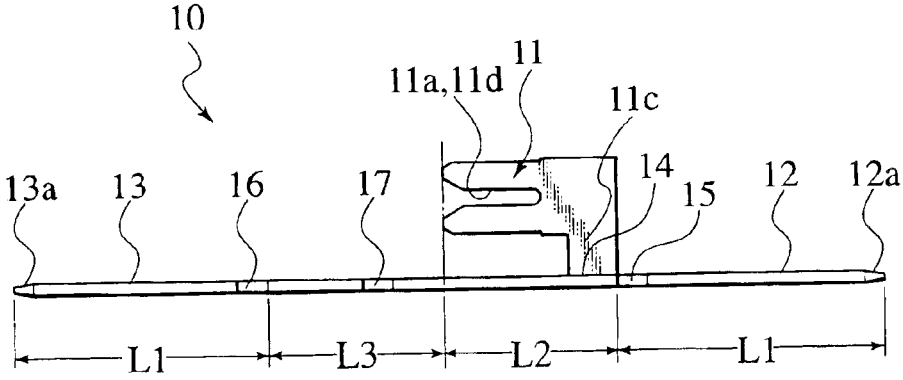
FIG. 4B is a side view of a press contact terminal in accordance with one embodiment of the present invention.

As shown in FIGS. 4A and 4B, the press contact terminal 10 is comprised of an erecting portion 11*c* having a press contact edge portion 11 pressed onto the electric wire 21, a pair of tab portions 12 and 13 opposed to each other with the press contact edge portion 11 arranged nearly at the middle position thereof, and a middle connection portion 14 that connects the pair of tab portions 12 and 13 to the erecting portion 11*c*. The press contact terminal 10 is integrally formed by molding.

The press contact edge portion 11 has an electric wire slit grove 11*a* opened in a direction of insertion, and an edge portion lid is formed inside the electric wire slit groove 11*a*.

The pair of tab portions 12 and 13 are arranged in a line, and the tips of the tab portions 12 and 13 are formed in tapered surfaces 12*a* and 13*a*, respectively. The lengths of the respective tab portions 12 and 13 are set at the same length L1. A pair of cutting grooves 15 and 16, which are first cutting marks, are formed at the edges of the respective boundaries between the tab portions 12 and 13 and the middle connection portion 14, respectively.

The erecting portion 11*c* is formed by bending the middle connection portion 14. That is, the press contact edge portion 11 is arranged at right angle to the pair of tab portions 12 and 13. Then, the length of the middle connection portion 14 is set such that in a case where the press contact edge portion 11 is pressed onto the electric wire 21 arranged on the wiring board 20, the pair of tab portions 12 and 13 protrude from the tab protrusion base planes 25 and 26 (see FIGS. 7A to 7C) of both surfaces of the wiring board 20. To be specific, lengths from the tip surface of the press contact edge portion 11 to the respective tab protrusion base planes 25, 26 are set at L2 and L3. Then, a pair of cutting grooves 17 and 17 are formed at both side edges of the middle connection portion 14 as second cut marks showing the cutting position of the tab portion 13 that protrudes from the opposite surface of the press contact edge portion 11 in a case where the press contact edge portion 11 is pressed onto the electric wire 21 arranged on the wiring board 20.

Figure 5:
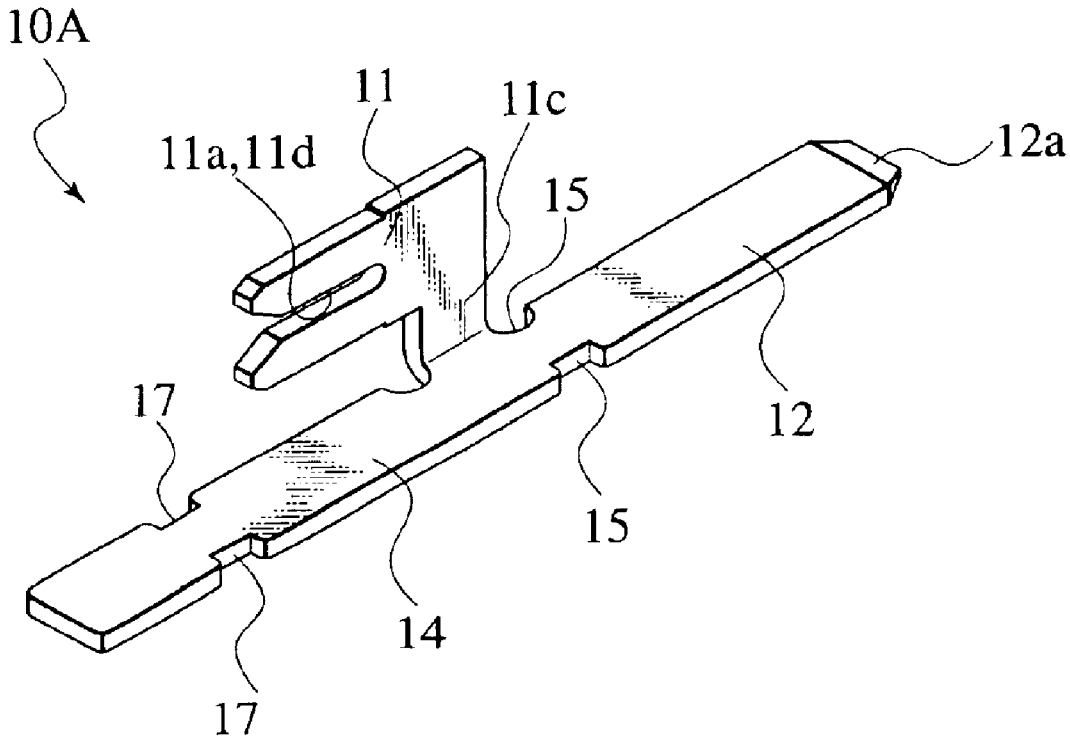
FIG. 5 shows one embodiment of the present invention, and is a perspective view of a press contact terminal in which one tab portion is cut off such that the other tab portion is provided in protruding manner only on the same plane as an electric wire.
Figure 6:
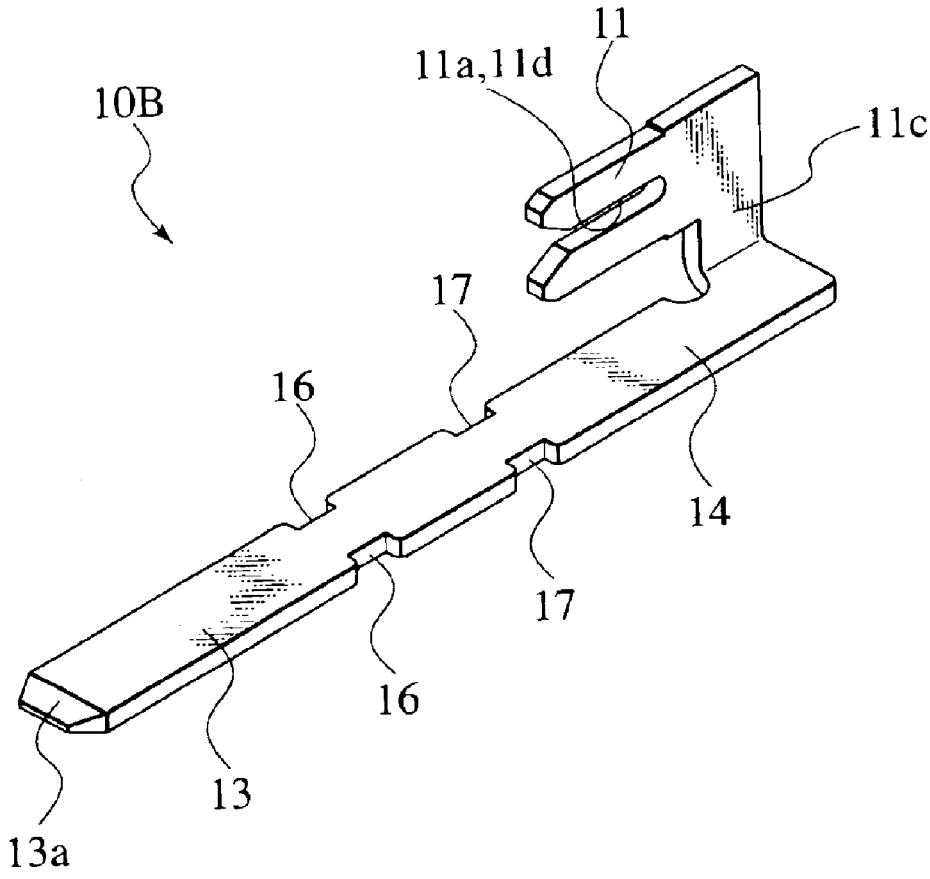
FIG. 6 shows one embodiment of the present invention, and is a perspective view of a press contact terminal in which one tab portion is cut off such that the other tab portion is provided in protruding manner only on a plane opposite to an electric wire.

The press contact terminal 10 constructed in this manner can be changed in shape into three types of the press contact terminal 10, shown in FIG. 4A, which is provided with the pair of tab portions 12 and 13, the press contact terminal 10A, shown in FIG. 5, in which the tab portion 13 is cut off along the first cutting groove 16, and the press contact terminal 10B, shown in FIG. 6, in which the tab portion 12 is cut off along the first cutting groove 15.

Next, the construction of the terminal mounting member 22 of the wiring board 20 will be described.

As shown in FIGS. 7A, 7B and C, the terminal mounting member 22 is protruded from the ambient surface of the wiring board 20 and a terminal fitting groove 23 is formed in this protruded terminal mounting member 22. The terminal fitting groove 23 is comprised of an edge fitting groove 23*a* in which the press contact part 11 is fitted and a middle connection through hole 23*b* in which the middle connection portion 14 is fitted. The edge fitting groove 23*a* is open at the top surface side of the wiring board 20 (a side indicated by an arrow X in FIG. 7A is called a top surface side and a side indicated by an arrow Y is called a bottom surface side) and the erecting portion 11*c* and the press contact edge portion 11 are fitted in an opening 23*c*. The bottom surface of the edge fitting groove 23*a* is made a fitting base plane 24 of the press contact terminal 10. That is, when the press contact edge portion 11 is inserted into the edge fitting groove 23*a*, an inserting-side edge portion of the press contact edge portion 11 abuts against the fitting base plane 24, whereby the insertion depth of the pressing edge pat 11 can be regulated.

The middle connection through hole 23*b* is open at the top and bottom surfaces of the terminal mounting member 22 and the top and bottom surfaces of the terminal mounting member 22 are made the tab protrusion base planes 25 and 26. That is, a length from the fitting base plane 24 to the upper tab protrusion base plane 25 is set at L2, and a length from the fitting base plane 24 to the lower tab protrusion base plane 26 is set at L3, respectively. The length of the above-mentioned middle connection portion 14 is set at (L2+L3).

The terminal mounting members 22 are provided at the terminal insertion positions A, B, C, I and J shown in FIGS. 3D and 3E such that the press contact terminals 10, 10A, 10B can be mounted from the obverse surface 20*a* side of the wiring board 20 and at the terminal insertion positions D, E, F, G and H except for the terminal insertion positions A, B, C, I and J such that the press contact terminals 10, 10A and 10B can be mounted from the reverse surface 20*b* side of the wiring board 20.

Next, a work of mounting the press contact terminals 10, 10A, and 10B on the wiring board 20 will be described.

From the obverse surface 20*a* side of the wiring board 20, the press contact terminals 10, 10A and 10B are mounted at the terminal insertion positions A, B, C, I and J. At the terminal insertion positions A, B and J, the press contact terminal 10 shown in FIGS. 4A and 4B is used. The press contact terminal 10 is inserted into the terminal fitting groove 23 of the wiring board 20 from the press contact edge portion 11 side. Then, the insulating outer sheath 21*b* of the electric wire 21 inserted into the electric wire slit groove 11*a* is cut by an edge portion 11*d*, whereby the conductive electric wire 21*a* inside the outer sheath 21*b* is pressed onto the press contact edge portion 11 and the lower tab portion 13 is protruded downward through the middle connection groove 23*b*. Then, as shown in FIG. 7A, the press contact edge portion 11 of the press contact terminal 10 is fitted in the edge fitting groove 23*a* and the middle connection portion 14 is fitted in the middle connection fitting groove 23*b*. In this manner, at the terminal insertion positions A, B and J, tab portions 12 and 13 conducting to the same electric wire 21 can be provided in a protruding manner on both surfaces of the obverse surface 20*a* and the reverse surface 20*b* of the wiring board 20.

At the terminal insertion position C, the press contact terminal 10A in which the tab portion 13 is cut off along the first cutting groove 16 shown in FIG. 5, is used. Here, the tab portion 13 can be cut off at the second cutting groove 17. As shown in FIG. 7B, this press contact terminal 10A is fitted in the terminal fitting groove 23 of the wiring board 20 as described above. In this manner, at the terminal insertion position C, the tab portion 12 conducting to the electric wire 21 can be provided in a protruding manner only on the obverse surface 20*a* of the wiring board 20.

At the terminal insertion position I, the press contact terminal 10B in which the tab portion 12 is cut off along the second cutting groove 15 shown in FIG. 6, is used. As shown in FIG. 7C, this press contact terminal 10B is fitted in the terminal fitting groove 23 of the wiring board 20 as described above. In this manner, at the terminal insertion position I, the tab portion 13 conducting to the electric wire 21 can be provided in a protruding manner only on the reverse surface 20*b* of the wiring board 20.

Then, from the reverse surface 20*b* side of the wiring board 20, the press contact terminals 10 are mounted at the terminal insertion positions D, E, F, G and H. At the terminal insertion positions D, E, F and G, the press contact terminals 10 shown in FIGS. 4A and 4B are used. As shown in FIG. 7A, this press contact terminal 10 is fitted in the terminal fitting groove 23 of the wiring board 20 as described above. In this manner, at the terminal insertion positions D, E, F and G, the tab portions 12 and 13 conducting to the same electric wire 21 can be provided in a protruding manner on both surfaces of the obverse surface 20*a* and the reverse surface 20*b* of the wiring board 20.

At the terminal insertion position H, the press contact terminal 10B in which the tab portion 12 is cut off along the first cutting groove 15 as shown in FIG. 6, is used. As shown in FIG. 7C, this press contact terminal 10B is fitted in the terminal fitting groove 23 of the wiring board 20 as described above. In this manner, at the terminal insertion position H, the tab portion 13 conducting to the electric wire 21 can be provided in a protruding manner only on the obverse surface 20*a* of the wiring board 20.

By the press contact work described above, as shown in FIGS. 3A to 3E, the press contact terminals 10, 10A and 10B inserted into the terminal insertion positions A, B, C, I and J are electrically connected to the respective electric wires 21 on the obverse surface 20*a* side, and the tab portions 12 and 13 are erected on the obverse and reverse surfaces 20*a* and 20*b* at the terminal insertion positions A, B and J, and the tab portion 12 is erected only on the obverse surface 20*a* at the terminal insertion positions C, and the tab portion 13 is erected only on the reverse surface 20*b* at the terminal insertion position I. Moreover, the press contact terminals 10 and 10B at the terminal insertion positions D, E, F, G and H are electrically connected to the electric wire 21 on the reverse surface 20*b* side, and the tab portions 12 and 13 are erected on the obverse and reverse surfaces 20*a* and 20*b* at the terminal insertion positions D, E, F and G, and the tab portion 13 is erected only on the obverse surface 20*a* at the terminal insertion position H.

As described above, in this electric connection box 1, the press contact terminals 10, 10A and 10B are pressed onto the electric wire 21 on the wiring board 20 from the side of the surface having the electric wire 21 arranged thereon, so that the tab portions 12 and 13 can be erected selectively on the surface having the electric wire 21 arranged thereon and the surface opposite thereto. Thus, in a case where the tab portions 12 and 13 are erected to the electric wire 21 on the surface having the electric wire 21 arranged thereon and the surface opposite thereto on the wiring board 20, it is easy to perform the press contact work of the press contact terminals 10, 10A and 10B and to check press contact connection.

In the above embodiment, in the press contact terminal 10, the press contact edge portion 11 is pressed onto the electric wire 21 from the side where the electric wire 21 is arranged, so that the tab portions 12 and 13 can be erected on both surfaces of the surface having the electric wire 21 arranged thereon and the surface opposite thereto. Thus, by pressing one press contact terminal 10 onto the wiring board 20, the tab portions 12 and 13 can be erected on both surfaces of the wiring board 20, which results in simplifying the press contact work and reducing the number of press contact terminals.

In the above embodiment, in the press contact terminals 10, 10A and 10B, the press contact edge portion 11 is arranged at right angle to the tab portions 12 and 13. Thus, when mating connectors (not shown) are put in or removed from the connector 5 and 6 of the tab portion 12 and 13, an external force of straight removing the press contact edge portion 11 is not applied. Therefore, it is possible to keep the stability of press contact of the press contact edge portion 11.

In the above embodiment, the terminal insertion positions A to F of the obverse surface 20*a* side and the reverse surface 20*b* side of the wiring board 20 are set at the same positions. Therefore, in a case where the tab portions 12 and 13 are erected on both surfaces, it is possible to use the same press contact terminals 10 and hence to reduce the number of components.

Moreover, in the above embodiment, the press contact terminals 10 are used which can be used in three patterns of a case where both tab portions 12 and 13 are used, a case where only the tab portion 12 on the same surface as the electric wire 21 is used, and a case where only the tab portion 13 on the surface opposite to the electric wire 21 is used. Therefore, it is possible to reduce the cost of manufacturing the terminals and to reduce the number of components. However, needless to say, it is also possible to manufacture three kinds of press contact terminals having the same construction as described above and to use these press contact terminals.

What is claimed is:

1. An electric connection box comprising:

a wiring board configured to have a first electric wire arranged on an obverse surface and configured to have a second electric wire arranged on a reverse surface;

an obverse cover arranged on the obverse surface of the wiring board including a first connector cavity;

a reverse cover arranged on the reverse surface of the wiring board including a second connector cavity; and a press contact terminal including:

a press contact edge portion configured to be pressed onto one of said first or second electric wires, and a tab portion erected in the first or second connector cavity, wherein the tab portion of the press contact terminal further includes:

a main body located in the obverse cover and the reverse cover, a first tab portion provided on a first side of the main body and positioned so that a portion of the first tab portion is protruded from the obverse cover arranged on the wiring board, a second tab portion provided on a second side of the main body and positioned so that a portion of the second tab portion is protruded from the reverse cover arranged on the wiring board, a first groove provided between the main body and the first tab portion, and a second groove provided between the main body and the second tab portion, wherein the press terminal is configured to selectively have a first configuration where both the first tab portion and the second tab portion are protruded, a second configuration where only the first tab portion is protruded while the second tab portion is separated from the main body by cutting the second groove, and a third configuration where only second tab portion is protruded while the first tab portion is separated from the main body by cutting the first groove.

2. The electric connection box of claim 1, wherein the main body, the first tab portion and the second tab portion of the press terminal are arranged in a line one another, and the press contact edge portion is provided in a plane which is arranged at a right angle to the main body.

3. The electric connection box of claim 1, wherein said first connector cavity is arranged at a position relative to one of said press contact terminals on said obverse surface, and said second connector cavity is arranged at a same position relative to said one of said press contact terminals on said reverse surface.

4. The electric connection box of claim 1, wherein the press contact terminal further includes an electric wire slit groove in the press contact edge portion.

5. The electric connection box of claim 4, wherein an edge of said electric wire slit groove is configured to cut an insulating outer sheath of an electric wire inserted into the electric wire slit grove.

* * * * *